US006428682B1

(12) United States Patent
Lein et al.

(10) Patent No.: US 6,428,682 B1
(45) Date of Patent: Aug. 6, 2002

(54) PROCEDURE FOR ELECTROCHEMICAL POLISHING OF AN ALUMINIUM SUBSTRATE TO OBTAIN A SPECULAR SURFACE

(75) Inventors: John Erik Lein, Ranheim; Cornelis Spooren, Stjørdal; Jostein Mårdalen, Trondheim; Jan Morten Søraker, Molde; Merete Hallenstvet, Tønsberg, all of (NO)

(73) Assignees: Norsk Hydro ASA, Oslo; Glamox Fabrikker AS, Molde, both of (NO)

( * ) Notice: Subject to any disclaimer, the term of this patent is extended or adjusted under 35 U.S.C. 154(b) by 0 days.

(21) Appl. No.: 09/508,242

(22) PCT Filed: Aug. 28, 1998

(86) PCT No.: PCT/NO98/00262

§ 371 (c)(1),
(2), (4) Date: May 23, 2000

(87) PCT Pub. No.: WO99/13134

PCT Pub. Date: Mar. 18, 1999

(30) Foreign Application Priority Data

Sep. 9, 1997 (NO) ..... 974173

(51) Int. Cl.[7] ..... C25F 3/00

(52) U.S. Cl. ..... 205/660; 205/682

(58) Field of Search ..... 205/660, 682

(56) References Cited

U.S. PATENT DOCUMENTS 5,616,231 A 4/1997 Askin et al. ..... 205/153

FOREIGN PATENT DOCUMENTS

| | | |
|---|---|---|
| GB | 714078 | 8/1954 |
| GB | 746772 | 5/1956 |
| GB | 958499 | 5/1964 |

*Primary Examiner*—Donald R. Valentine
*Assistant Examiner*—Thomas H. Parsons
(74) *Attorney, Agent, or Firm*—Wenderoth, Lind & Ponack, L.L.P.

(57) ABSTRACT

A process for removing or reducing the directionality or anisotropy of a surface and for making the surface specular on a substrate material consisting of aluminium or an aluminium alloy, by (a) chemically etching the substrate material, (b) subjecting the etched substrate material substrate material to electrochemical polishing by using a solution, and (c) subjecting the substrate material to additional chemical etching and electrochemical polishing directly after step (b), wherein the surface of the substrate material is not exposed to air between the etching and the electrochemical polishing.

13 Claims, No Drawings

PROCEDURE FOR ELECTROCHEMICAL POLISHING OF AN ALUMINIUM SUBSTRATE TO OBTAIN A SPECULAR SURFACE

CROSS-REFERENCE TO RELATED APPLICATION

This application is a 371 application of PCT/NO98/00262, filed Aug. 28, 1998.

BACKGROUND OF THE INVENTION

1. Field of the Invention

The present invention concerns a procedure for removing/reducing the directionality or anisotropy of a surface and making the surface specular on a substrate material consisting of aluminium or an aluminium alloy.

The substrate material can be produced by casting, extrusion, rolling or other shaping techniques and the surface properties of the substrate material may be of greater or lesser significance. For example, stringent requirements have to be made for the surface properties of a substrate material which is to be used for reflector purposes. Materials which are to reflect visible light are particularly surface-critical and the description which follows will concern such materials in particular.

In order for a material to be suitable as a reflector material, such as for lighting purposes, it must meet a number of requirements. The material must have high reflectivity for light and it should preferably have certain light dispersion properties, depending on the application. Moreover, the material must have sufficient scratch resistance to allow cleaning. Any layers on the surface of the material must adhere well to the substrate. The material should also be as light as possible and may typically be based on rolled aluminium.

2. Description of the Related Art

Already as early as in the thirties, it was realised that aluminium meets many of the above requirements. The reflectivity of this material is exceeded only by silver. The shaping properties of aluminium are good and its weight is low. For functional and aesthetic reasons, it used to be desirable that lighting materials had as bright a surface as possible. Chemical and electrochemical polishing processes were developed which made it possible to transform the relatively rough rolled surface of a highly pure material into a bright surface. In addition, these processes contributed to increasing the reflectivity of the rolled substrate. Aluminium is a soft material and when it comes into physical contact with other materials, damage occurs, for example in the form of scratches. In addition, a bare aluminium surface is exposed to corrosion. For most applications of aluminium, including for lighting purposes, it is, therefore, necessary to protect the surface. The most common methods of protection are anodisation or lacquering.

After 1945, aluminium started to be used on a large scale for lighting purposes. The production of reflectors in aluminium was a typical piece part process. First the reflector parts were shaped to form the desired geometry and then they were assembled to form a complete reflector or screen. The screens were then polished chemically or electrochemically and subsequently protected by anodisation. Lacquering was also used as a treatment after the electrochemical process.

A common feature of the piece part or batch processes was the long treatment time required to polish the relatively rough starting material. With the chemical processes then in use, the quality of the starting material was decisive if the treatment time was to be reduced. Gradually, rolling mills improved their processes and became able to supply materials with considerably greater brightness. Thus it becomes possible to reduce the polishing times, which gradually allowed for the introduction of continuous brightening process for aluminium strips.

Continuous plants for chemical or electrochemical polishing and anodisation were taken into use in the mid-fifties. Continuous surface treatment was considerably more cost-effective than the traditional piece part processes. Rolling mills, particularly in Europe, continued to improve their processes and the need for polishing become less and less. Today, the brightness of the material is mainly created in the rolling mill. Lines for electrochemical polishing and anodisation have become less important as a consequence. They are mainly used to remove a surface layer in order to increase the reflectivity of the material. The brightness is usually not altered significantly as a consequence of this. Perhaps the most important task of the brightening line today is thus to form protection for the aluminium by means of the anodisation which normally follows.

Specular materials are produced today by cold-rolling pure aluminium alloys (typically 99.8% Al or purer, for example AA 1080) in a rolling mill. The material's reflectivity is subsequently increased by means of chemical or electrochemical treatment, which involves removing a thin layer of the material's surface without altering the brightness significantly. The material is then protected by anodisation or lacquering. The requirements for the rolling quality and alloy quality (among other things, its purity) are usually regarded as being fundamental for a satisfactory result.

The surface is polished either chemically or electrochemically. The electrochemical polishing process is generally preferred when polishing a bright starting material and has the potential to produce a more specular surface than chemical polishing. Chemical polishing, in turn, can be used to advantage to polish raw materials with a somewhat rougher rolling quality. Chemical polishing is today regarded as the best process for giving relatively rough surfaces a considerable increase in brightness. However, as rolling mills now usually supply very bright material, chemcial polishing is gradually becoming a less relevant process. If the starting material is already bright, the electrochemical process will produce a brighter end product than the chemcial process.

Both chemical and electrochemical polishing may result in topographical disturbances or so-called gassing defects. In today's production processes, it is desirable to avoid these defects. This is done by using a starting material of a sufficient quality and by correcting the process conditions in the process bath.

The problems associated with gassing defects are discussed and described in the following article:

"The incidence and avoidance of gassing defects in chemical and electropolishing of aluminium A. W. Clifford and D. J. Arrowsmith, University of Aston in Birmingham, Dept. of Metallurgy and Materials, Feb. 23 1978".

The tests described in this article were carried out in acid mixtures which are difficult to regenerate. Particularly in processes which involve major removal of substrate material, it will be of great significance that the chemical can be regenerated expediently.

In order to obtain a satisfactory result with the processes described in the article, the treatment time will easily be as much as 10 minutes. With treatment times of this order, these processes will not be feasible in connection with continuous treatment of substrate materials (strip process).

Furthermore, aluminium materials with a low content of alloy elements are preferably used as, according to the article, the alloy elements (in particular the size of the intermetallic particles) are assumed to be of major significance in relation to the formation of defects on the surface of the substrate. The article supports the general view that a sufficient purity of the aluminium material is necessary in order to be able to control and prevent the development of defects so as to achieve a satisfactory end product.

BRIEF SUMMARY OF THE INVENTION

The present invention concerns a procedure which makes it possible to produce a material with qualitatively good optical properties based on aluminium alloys of semi-bright rolling quality, which is a considerably rougher quality than that which is currently used for the production of specular lighting materials. Moreover, in accordance with the present invention, it is possible to use a less pure, less expensive starting material than previously, for example qualities such as AA 1200 (Al<99.2%) or AA 1050 (Al<99.5%) for the production of specular material. Moreover, it is possible to use recycled Al metal, for example AA 1200 recycled, which results in environmental gains. Moreover, the process uses chemicals which can be regenerated, which results in both environmental and financial gains. In accordance with the present invention, this has been made possible by means of a new, improved electrochemical polishing process. In accordance with the present invention, the brightness may be increased more than by means of processes of the prior art on the basis of the specified raw materials and available treatment times. This applies both to the relative increase in brightness between the starting material and the finished material and to the absolute brightness in the finished product. With the improved process in accordance with the present invention, the treatment time can also be reduced in relation to processes of the prior art, which makes it possible for the process to be used in a plant for the continuous treatment of a substrate material.

DETAILED DESCRIPTION OF THE INVENTION

The present invention is directed to a process for removing or reducing the directionality or anisotropy of a surface and for making the surface specular on a substrate material consisiting of aluminium or an aluminium alloy, which comprises (a) chemically etching the substrate material, (b) subjecting the etched substrate material to electrochemical polishing by using a solution, and (c) subjecting the substrate material to additional chemical etching and electrochemical polishing directly after step (b), wherein the surface of the substrate material is not exposed to air between the etching and the electrochemical polishing.

The substrate material may be an aluminium alloy which has been recycled, for example AA 3105, or a profile alloy such as AA 6060.

The substrate material to be treated may have a brightness which is lower than 1200 GU.

The substrate material also may be a rolled aluminium strip, and the process may be carried out as a continuous strip process.

The present procedure involves treatment of the material in several successive stages. The process involves chemical etching, immidiately followed by electrochemical polishing, and a new chemical etching immediately followed by electrochemical polishing. The material is preferably not exposed to air between the chemical etch and the electrochemical polish stage.

The starting material of the process is characterised by two properties which distinguish it from the norm in today's production of lighting materials:

The rolling quality is considerably rougher and

The alloy is less pure than normal.

While lighting products are produced today in rolling mills without the subsequent chemical or electrochemical process altering the starting material's surface topography significantly, an essential feature of the present invention is that it allows the use of a less expensive raw material by improving the chemical or electrochemical process.

As mentioned earlier, such processes are associated with the emergence of gas bubbles, which can produce gassing defects in the finished procduct. However, the process proposed allows better control of the emergence of gas bubbles on the surface of the material so that it is possible to produce a specular product without having to make stringent requirements for the quality of the starting material.

The present invention will be described in further detail in the following.

The alloy which is used may preferably be AA 1200 recycled. However, AA 1200 based on a primary metal or AA 1050 can also be used. It is also possible to use a recycled alloy of type AA 3105.

The rolling quality must be relatively good for the end result to be satisfactory. The material used in the example consists of a semi-bright-rolled quality. This quality lies between mill finish (MF) and bright-rolled quality.

The optical properties of the raw material may be as follows:

| | | |
|---|---|---|
| Total reflection[1]: | Approximately 80% | |
| Brightness at 20°[2]: | In rolling direction (RD): | 1050–1200 GU |
| | Transverse to rolling direction (TD): | 1000–1150 GU |
| Roughness: | Ra[3]: | 0.60–0.12 micrometers |

[1]: measured in accordance with DIN 5036 part 3
[2]: measured in accordance with DIN 67530
[3]: measured by using a drag pin Before the actual polishing process begins, the material is degreased. This is done mainly in order to avoid rolling oil and dirt entering and contaminating the process bath. Degreasing may be done by using organic solvents, hot water (possibly with tenside), an acid or a basic solution.

Before the electrochemical polishing stage, brief chemical etching is carried out. The etching takes place preferably in the same bath as that in which the electrochemical process is to take place. An important feature of the present invention is that the material is not removed from the bath between etching and electropolishing. If the material is exposed to the air before the electrochemical polishing, the quality of the end product will be altered, usually for the worse.

The bath for the chemical etching may consist of phosphoric acid, water and a certain quantity of dissolved aluminium. The acid bath may have different concentrations and temperatures and the dwell times may also be varied. Variation of the parameters provides the opportunity to avoid gas-generated elevations on the surface of the material.

It is assumed that the generation of gas bubbles is associated with defects and inhomogeneities in the surface itself. Chemical etching before electropolishing will condition the surface in such a way that optimal avoidance of gassing defects can be achieved. If the material is exposed to air so that a natural oxide layer is formed, this conditioning may be ruined. Control of the emergence of gas bubbles can be achieved in particular by means of the use of prior etching.

It is important, in connection with the production of the specular quality, that the dwell time in the acid etch is not so long that coarse etching topography is produced. If too coarse an etching topography is formed, this cannot be removed even by thorough electropolishing.

The electropolishing is done in the same bath as the chemical etching. In practice, this will be done by switching on the power for the electropolishing after a certain time in a piece part process. For a continuous strip process, this must be done differently. For example, the strip can pass through different zones in the same vessel so that it is not exposed to a significant electric field before the etching process has been carried out.

Another solution is for the strip to pass from one etching vessel to another while it is kept moist and is not exposed to the air.

A third solution, perhaps the easiest solution in technical terms, is to carry out the prior chemical etching by spraying the strip with phosphoric acid just before it goes down into the electropolishing bath.

The electropolishing itself can be carried out both in constant current and in constant voltage mode. It can also be carried out in different acid concentrations and with different additives in the bath. Moreover, the voltage and/or current can be varied to achieve different surface qualities.

For a strip process, it is important for the process time to be kept as short as possible so that the production rate results in an economical process. Process times of approximately one to two minutes are usually required but there is potential for improvement of the products if longer process times are allowed. This applies to both the chemical polishing and electropolishing. Longer times can be used for piece part process.

After the first electropolishing, the process is repeated by a new chemical etching followed by a new electropolishing. In practice, this is carried out in a process line consisting of two identical steps. Alternatively, the material could be wound up after the first electropolishing for thereafter being processed in the same line another time. The bath composition for such a double chemical etching and electropolishing is the same as ealier described. The total process time is also of the same order as for the earlier described process.

It should be understood that, in connection with the process described above, it is possible to use accessory agents, for example to adapt the viscosity in the bath to a desired value. Such agents will represent the prior art for experts and will not, therefore, be described in further detail here.

Moreover, the present invention is not restricted to processing strips for producing lighting products. Thus the present invention may be used piece part manufacture of various products. These may be extruded products for various structures such as buildings or mechanical structures. For example, the present invention may expediently by used in connection with the surface treatment of profiles, for example of alloy type AA 6060. Furthermore, the present invention may be used for cast parts which can be used in mechanical or building structures.

Products produced in accordance with the present invention may preferably be finished by laquering. However, anodisation may also be used. The choice of type of finishing will depend on the quality of the raw material, such as its purity.

The present invention shall be described in the following example.

The example concerns the production of a specular material involving restrictions to the exposure time (continuous strip process). The objective of the process is to increase the brightness as much as possible within the available process time, to avoid the processed material becoming too directional (either by the rolling scores still being visible or flow marks being produced in the process) and to bring the total reflection up to an acceptable level for the lighting product.

EXAMPLE

Process Conditions

Starting material:

AA 1200 semi-bright-rolled, optical specifications below

Chemical etching:

Bath: concentrated phosphoric acid (85% weight)

Low Al concentration: 0–8 g/l Al

Temperature: 55° C.

Exposure time: 10 seconds

Electrochemical polishing:

Same bath as for chemical etching

Exposure to air to be avoided

Exposure time 60–120 seconds

Voltage: 18 V

Chemical etching:

As above

Electrochemical polishing:

As above

Finished Product

A product is produced with an isotropically bright appearance. The final brightness value is approximately 1500 GU (R20). The total reflection in the finished product is affected by the oxide layer generated on the surface during the electrochemical treatment. The quality of this finished product is improved by extending the process times. However, a longer process time is not desirable in this case. The results are shown in Table 1:

TABLE 2

| | Total reflection | Brightness R20(RD) | Brightness R29(TD) |
|---|---|---|---|
| Starting material | 77–79% | 1050–1150GU | 950–1050GU |
| After 1st electro-chemical polishing | 88% | 1400–1500GU | 1325–1425GU |
| Finished | 88% | 1500–1550GU | 1450–1500GU |

What is claimed is:

1. A process for removing or reducing the directionality or anisotropy of a surface and for making the surface specular on a substrate material consisting of aluminium or an aluminium alloy, which comprises (a) chemically etching the substrate material, (b) subjecting the etched substrate material to electrochemical polishing by using a solution, and (c) subjecting the substrate material to a new chemical etching and electrochemical polishing directly after step (b), wherein the surface of the substrate material is not exposed to air between the etching and the electrochemical polishing.

2. A process in accordance with claim 1, wherein the chemical etching is conducted with a solution comprising phosphoric acid.

3. A process in accordance with claim 1, wherein the electrochemical polishing is conducted with a solution comprising phosphoric acid.

4. A process in accordance with claim 1, wherein the substrate material is an aluminium alloy which has been recycled.

5. A process in accordance with claim 4, wherein the substrate material is AA 3105.

6. A process in accordance with claim 1, wherein the substrate material is a profile alloy.

7. A process in accordance with claim 6, wherein the substrate material is AA 6060.

8. A process in accordance with claim 1, wherein the substrate material to be treated has a brightness which is lower than 1200 GU.

9. A process in accordance with claim 1, wherein the substrate material is a rolled aluminium strip and the process is carried out as a continuous strip process.

10. A process in accordance with claim 1, wherein the chemical etching is conducted with a solution of at least 85% by weight of phosphoric acid.

11. A process in accordance with claim 1, wherein the chemical etching is conducted at 55° C.

12. A process in accordance with claim 1, wherein each chemical etching is conducted for 10 seconds.

13. A process in accordance with claim 1, wherein the electrochemical polishing is conducted for 60–120 seconds.

* * * * *